US011346601B1

(12) United States Patent
Hammerman et al.

(10) Patent No.: US 11,346,601 B1
(45) Date of Patent: May 31, 2022

(54) COMPLETELY GREEN SYSTEM FOR COOLING REFRIGERATORS, FREEZERS AND AIR CONDITIONERS THAT HAS NO HCFCS OR CFCS

(71) Applicants: John J Hammerman, Sheridan, MT (US); William G Moon, Lehi, UT (US)

(72) Inventors: John J Hammerman, Sheridan, MT (US); William G Moon, Lehi, UT (US)

(73) Assignee: Reflect Scientific, Provo, UT (US)

( * ) Notice: Subject to any disclaimer, the term of this patent is extended or adjusted under 35 U.S.C. 154(b) by 0 days.

(21) Appl. No.: 17/389,221

(22) Filed: Jul. 29, 2021

(51) Int. Cl.
*F25J 1/00* (2006.01)
*F25B 45/00* (2006.01)

(52) U.S. Cl.
CPC ..... *F25J 1/0012* (2013.01); *F25B 45/00* (2013.01)

(58) Field of Classification Search
CPC ..... F25J 1/0012; F25J 1/0022; F25B 45/00
USPC ..... 62/615
See application file for complete search history.

(56) References Cited

U.S. PATENT DOCUMENTS 5,584,194 A * 12/1996 Gardner ..... C01B 23/0094 95/52
6,026,648 A * 2/2000 Cloarec ..... A23B 4/066 62/70
6,112,428 A * 9/2000 Schaff ..... F26B 21/083 34/81
7,165,422 B2 * 1/2007 Little ..... F25J 1/0225 62/51.1
10,859,305 B1 * 12/2020 Ellis ..... F25D 3/102
2018/0112824 A1 * 4/2018 Gaddis ..... F17C 5/04
2021/0010751 A1 * 1/2021 Allidieres ..... F25J 1/001

* cited by examiner

*Primary Examiner* — Ana M Vazquez
(74) *Attorney, Agent, or Firm* — Patent PC; Bao Tran

(57) ABSTRACT

A system for cooling residential or commercial refrigerators, freezers, ULT freezers, and air conditioners is disclosed using liquified gas as the refrigerant. The system has no HCFCs or CFCs. The system is completely non-polluting and returns the refrigerant air to the environment in a cleaner state than the input air. The system is totally green, obtaining all energy from an array of solar panels and may be operated independently and remotely from all other energy sources. The refrigerant may be liquid air or liquid nitrogen. The system may also operate on-the-grid for power.

18 Claims, 5 Drawing Sheets

COMPLETELY GREEN SYSTEM FOR COOLING REFRIGERATORS, FREEZERS AND AIR CONDITIONERS THAT HAS NO HCFCS OR CFCS

BACKGROUND OF THE INVENTION

CFCs and HCFCs are used in almost all cooing devices today. These chemicals are lighter than air, causing the molecules to rise, where ultraviolet light frees the chlorine in these elements. Since even one chlorine atom from these refrigerants can destroy thousands of ozone molecules, these chemicals reduce the Earth's protective ozone layer.

SUMMARY OF THE INVENTION

The present invention obtains power from the sun through the use of solar panels. The refrigerant is environmental air from the local area. The intake air is filtered and liquefied using a Linde or a Claude process which is powered by the solar panels. The liquefied air is stored in a cryogenic bulk tank. The cryogenic bulk tank is connected to homes, businesses or hospitals. Inside these facilities, the liquified gas lines are connected to the cooling devices. When there is a call for cooling refrigerators, freezers, ULT freezers and air conditioners, a valve opens on the device, causing the liquified gas to flow through the cooling pipes inside the device, and cool the unit. Since the liquified gas is stored at −196 C, it has the ability to cool faster than mechanical cooling devices and without HCFCs or CFCs. After use, the liquified gas has absorbed heat from the device and phase changes to a gas. It is released into the air, with absolutely no pollutants and is slightly more purified, since the air was filtered as it entered the system. The air may be released either outside or inside the facility without any pollution.

This system is completely energy independent of any source except the solar panels. These solar panels power the compressor, fans, control panels, and electric solenoid valves that open when there is demand for cooling. The refrigerant is air, and after use it is returned to the environment, cleaner than when it entered the system.

The system is not limited to liquid air as the refrigerant. Liquid nitrogen may also be used as the refrigerant.

The electric power source is not limited to solar panels. Power can also be obtained from an on-the-grid source, or from an electric generator.

The cryogenic refrigerant production is not limited to an air liquefier on site. An air liquefier plant may be built to produce liquified gas for an entire city. Also, an air separator may be used to separate the nitrogen from the air, and used as the refrigerant. The air liquefier may also be scaled down to supply a single home.

The refrigerant storage is not limited to a bulk tank. Bulk tanks may range from 5,000 liters to 1,000,000 liters. An alternate solution is a single 180 liter dewar tank located outside a private residence, restaurant, or even a commercial facility.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION OF THE INVENTION

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
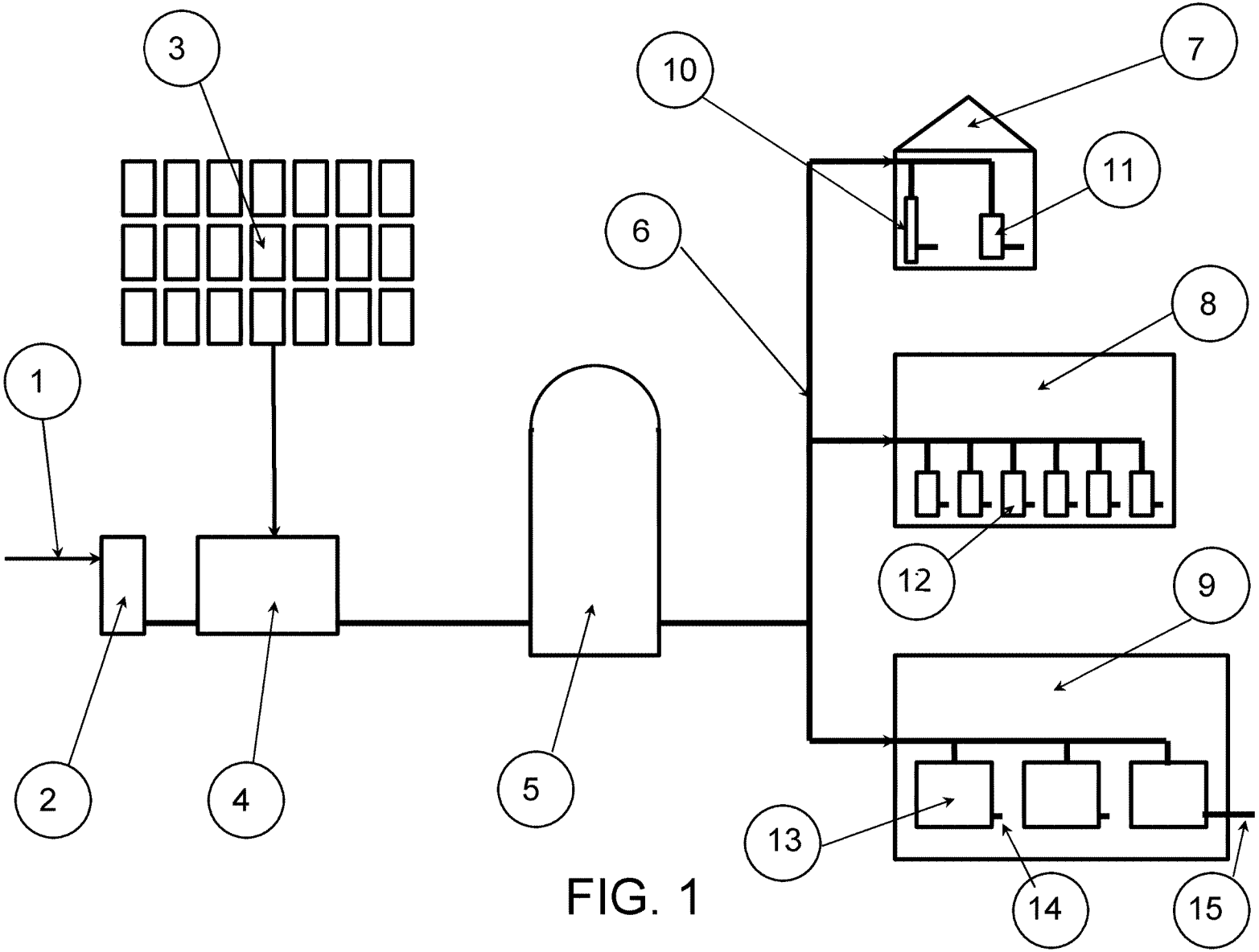
FIG. 1 is a diagram of the present invention with an air liquefier as the refrigerant source for a local area.

Now referring to FIG. 1, the invention is composed of an air inlet 1 that takes air from the surrounding environment. An air filter 2 removes unwanted pollutants from the air. Solar panels 3 convert ultraviolet rays from the sun into electricity and are connected to the air liquefier 4. The air liquefier will have a dryer to remove unwanted water from the refrigerant. The air liquefier 4 operates only on electricity and alternately compresses, cools, and expands the air until it has phase changed to a liquid. This particular process is known as the Linde process. Other processes such as the Claude process may also be used. As an alternate source of refrigerant, a separator may be added and the nitrogen may be separated from the air and used as the refrigerant. The liquified gas (such as liquid air or liquid nitrogen) flows to a cryogenic storage tank, known as a bulk tank 5, where it is stored. The bulk tank 5 is composed of a tank within a tank, similar to a thermos bottle, to reduce evaporation of the liquid air by insulating the inner tank from the outer tank with a vacuum. This type of storage device is desired because the liquid air or liquid nitrogen is extremely cold at about −196 C. The bulk tank ranges in size from 5,000 liters to 1,000,000 liters.

A vacuum jacketed pipe (VJP) 6 is designed similar to the bulk tank 5, with an inner pipe that is surrounded by an outer pipe and a vacuum between the pipes that insulates the liquified gas from the environment. The VJP 6 delivers the liquified gas to homes 7, grocery stores 8, and laboratories 9 that have cooling devices. Liquid air or liquid nitrogen is the refrigerant that operates air conditioners 10, refrigerators 11, freezers 12, and ultra low temperature (ULT) freezers 13. The liquid air or liquid nitrogen will phase change from liquid to gas as it cools the devices. The exhaust gas 14 from the liquified gas may be released into the facility with no pollution, since it is air from the outside environment. It is also cleaner than the outside air, because it has been filtered, and will be cooler than the facility or home. As an added feature, the exhaust air may be used to cool the facility or home. In the winter, the cold exhaust air may be piped outside the facility 15. If liquid nitrogen is used as the refrigerant, then it must be exhausted outside the facility 15, to prevent depletion of air in the facility.

Figure 2:
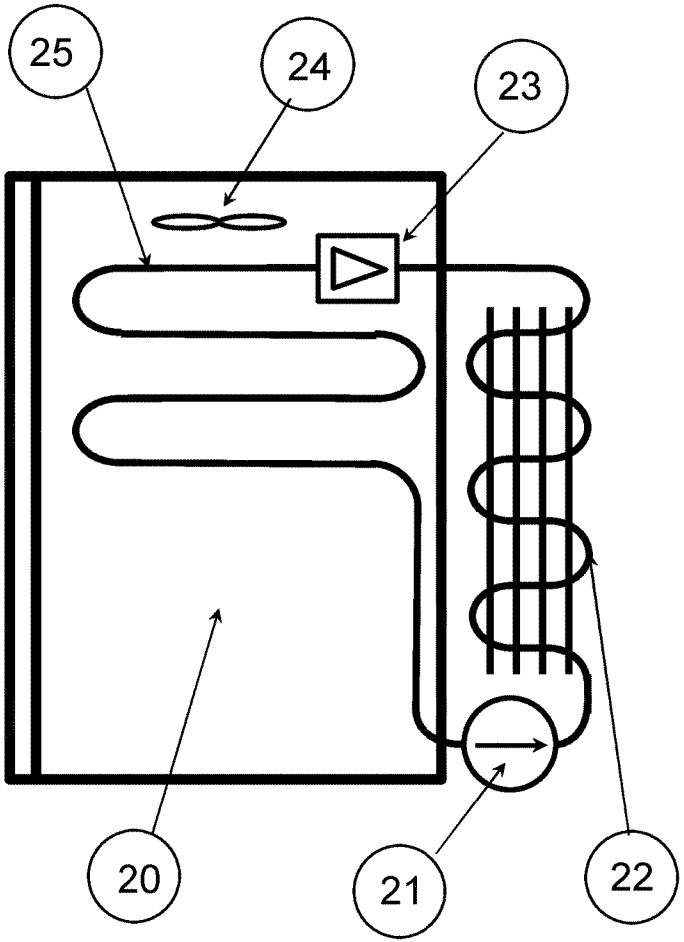
FIG. 2 (Prior Art)
FIG. 2 is a side view of a typical prior art mechanical cooling device with a payload bay.

FIG. 2 demonstrates the operation of a typical prior art mechanical fridge, freezer, or ULT freezer with a payload bay 20. This operation is explained in detail, so that the conversion and retrofitting of this device for a liquid air or liquid nitrogen refrigerant can be easily understood. A compressor 21 pressurizes the HCFC or CFC gas. The process of compressing heats the gas. As the gas flows through the condenser 22, heat is removed from the gas and it becomes a liquid. The liquid refrigerant flows through an expansion valve 23 and the gas quickly expands, becoming cold. This is known as the Joule-Thomson effect. The expanded and cooled refrigerant flows through the evaporator 25 where it absorbs heat and cools the device. A fan 24 aids in distributing the air throughout the fridge or freezer. The refrigerant returns to the compressor 21, where the cycle repeats. The lowest temperature refrigerant, R134a, can operate as low as −103 C. However, the liquid air or liquid nitrogen as a refrigerant operates much colder, at −196 C and therefore cools much faster than a mechanical cooling device with HCFCs or CFCs.

Figure 3:
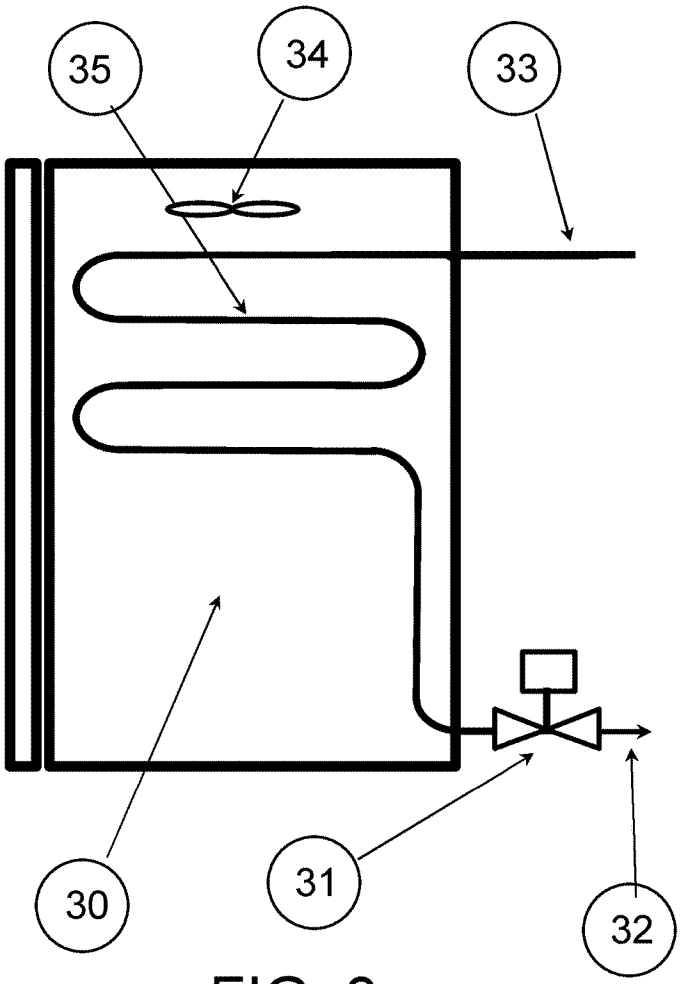
FIG. 3 is a side view of a cooling device with a payload bay that has been retrofitted or designed specifically to operate on liquid air or liquid nitrogen.

FIG. 3 demonstrates a method for easily retrofitting and converting a typical mechanical cooling device with a payload bay 20 to operate with liquid air or liquid nitrogen 30. The cooling device 30 is converted by removing the compressor 21, the condenser 22, and the expansion valve 23. An electric solenoid valve 31 is installed where the compressor 21 was located. The electric solenoid valve 31 is connected to the same electrical lines as compressor 21 was connected before removal. The retrofitted device can then operate using the same thermostat controls as the prior art mechanical device; when there is demand for cooling the electric solenoid valve 31 is energized instead of the compressor 21. The VJP 6 (FIG. 1) is attached to the inlet line 33, and provides the refrigerant as needed. The exhaust line 32 is left open to the facility if the refrigerant is liquid air, or the exhaust line 32 is plumbed to the outside of the facility if the refrigerant is liquid nitrogen. When there is a demand for cooling in the device 30, electric solenoid valve 31 is energized and opens, allowing liquid air or liquid nitrogen 33 from the bulk tank 5 FIG. 1 to flow into the evaporator 35. The liquid air at −196 C quickly absorbs heat from the cooling device 30. Fan 34 aids in distributing the air past the cryogenically cooled evaporator 35 and into the fridge or freezer.

The process for retrofitting existing mechanical refrigerators and freezers can be accomplished with minimal changes to the cooling device. Also, the cooling devices can also be designed from the beginning, specifically for liquid air or liquid nitrogen. The insulated walls may be made of vacuum insulated panels (VIP), which is much better insulation than the polyurethane foam filling used in most mechanical cooling devices. The foam has an R-factor of about 5 BTU/hr/sq ft/deg F./inch, while a VIP has an R-factor as high as 60, which is a much better insulator.

Figure 4:
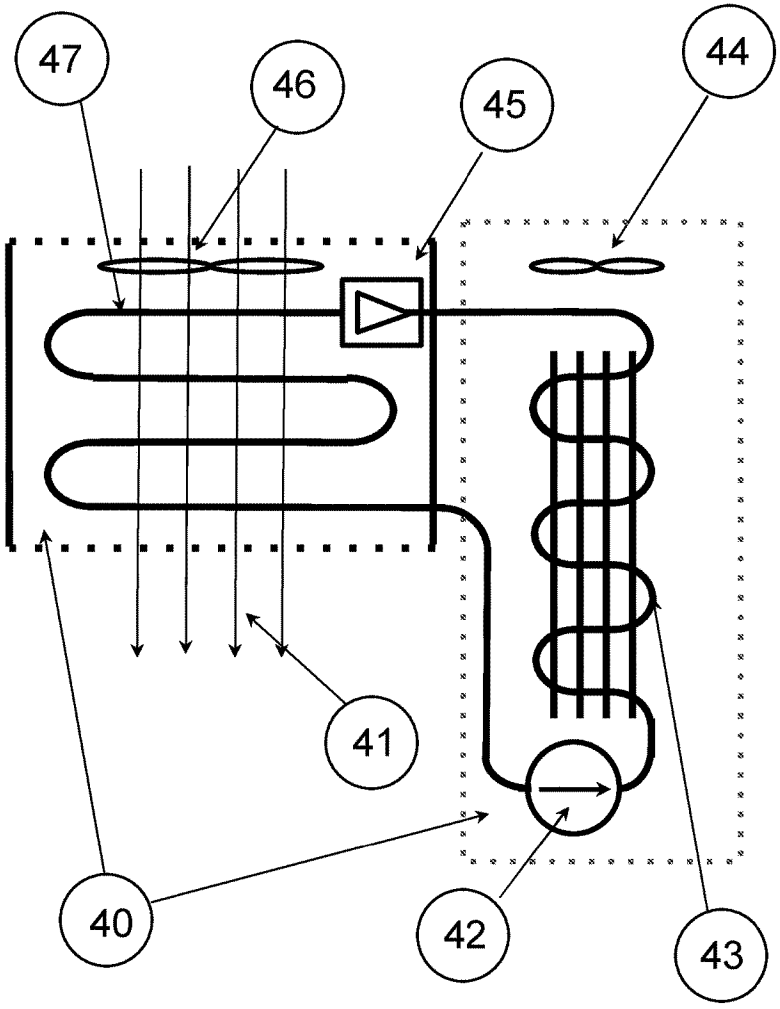
FIG. 4 (Prior Art)
FIG. 4 is a side view of a typical prior art mechanical air conditioner.

FIG. 4 demonstrates the operation of a typical prior art mechanical air conditioner 40. The operation is functionally the same as the prior art mechanical freezer 20 (FIG. 2), except the compressor 42, condenser 43 and fan 44 are typically located outside the facility, for easier removal of heat. The air conditioner expansion valve 45, fan 46, and evaporator 47 perform the same functions as the prior art freezer components. Another difference is the air circulates through the room instead of the payload bay.

Figure 5:
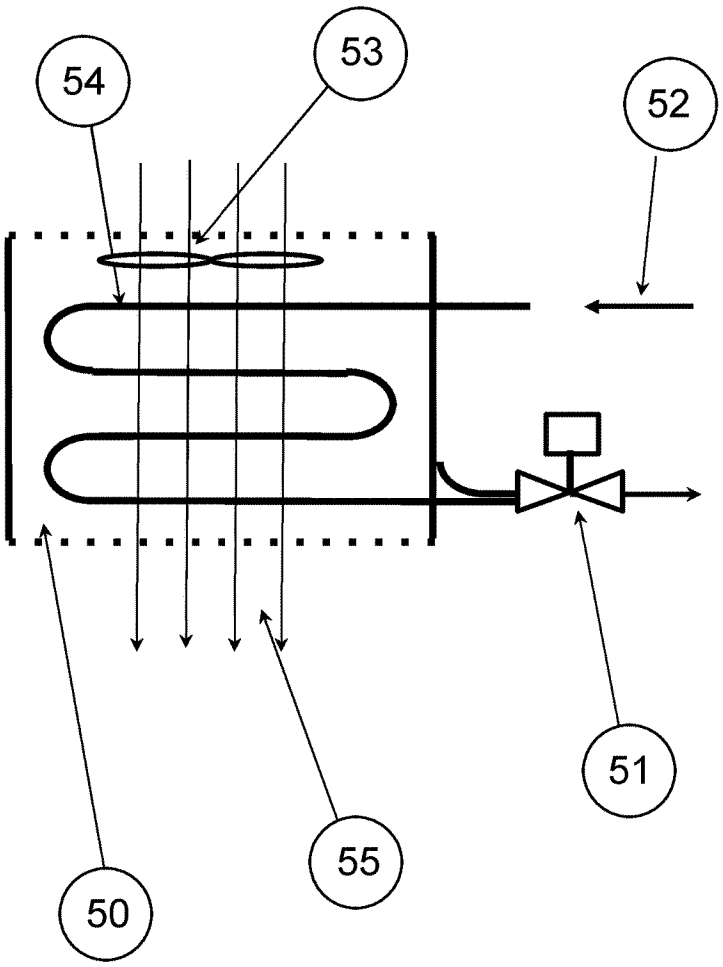
FIG. 5 is a side view of an air conditioner that has been retrofitted or designed specifically to operate on liquid air or liquid nitrogen.

FIG. 5 demonstrates a method for easily retrofitting and converting a typical mechanical air conditioner 40 to operate with liquid air or liquid nitrogen 50. The entire condenser assembly of the prior art air conditioner 40, outside the facility, is removed 42, 43, & 44. The electric solenoid valve 51 replaces the compressor 42. In operation, upon demand for cooling, the electric solenoid valve 51 is energized and opens, creating liquid air or liquid nitrogen flow through the evaporator 54, and the air is cooled as fan 53 blows air past the cryogenically cooled evaporator 54.

Figure 6:
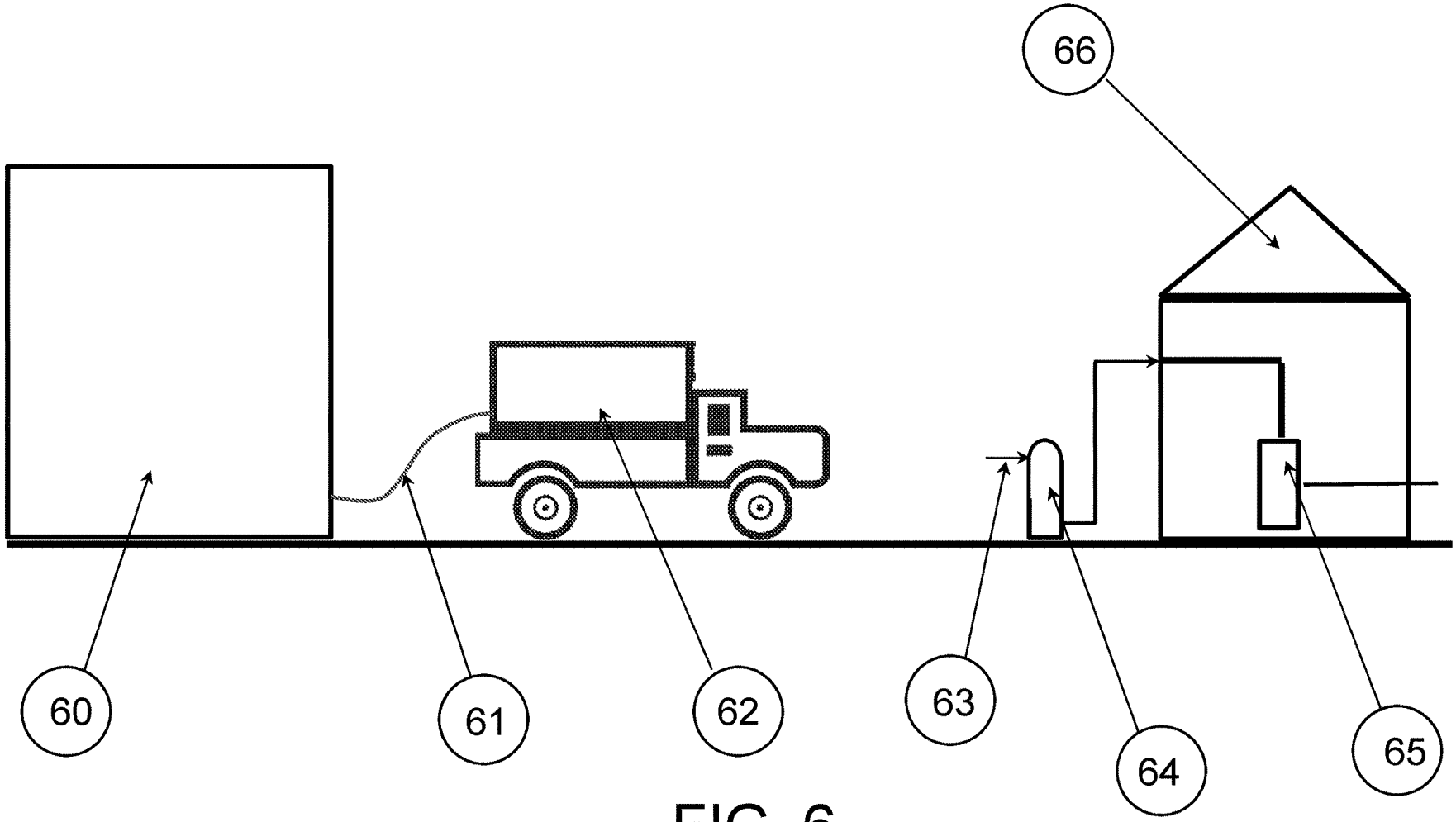
FIG. 6 is a diagram of an alternate system using an air liquefier plant to supply refrigerant to an entire community

FIG. 6 demonstrates a large scale air liquefier 60 for a community. The air liquefier 60 may be powered by a solar panel farm, or powered by the grid. The refrigerant would be transferred from the air liquefier 60 to the cryogenic liquid tank truck 62 using a vacuum jacketed flexible line 61 attached to the cryogenic liquid tank truck 62. The cryogenic liquid tank truck 62 could deliver the refrigerant to a dewar tank 64 outside home 66, by attaching the vacuum jacketed flexible line 61 to the inlet 63 of the dewar tank similar to the process used today, to deliver and store propane for home heating. The dewar tank could be as small as 180 liters and still supply coolant to a refrigerator which would use only 10 liters of refrigerant per day. At that rate, the 180 liter tank would supply the refrigerator for 18 days. A much larger tank may be used and supply liquid nitrogen to several cooling devices such as air conditioners and freezer.

Figure 7:
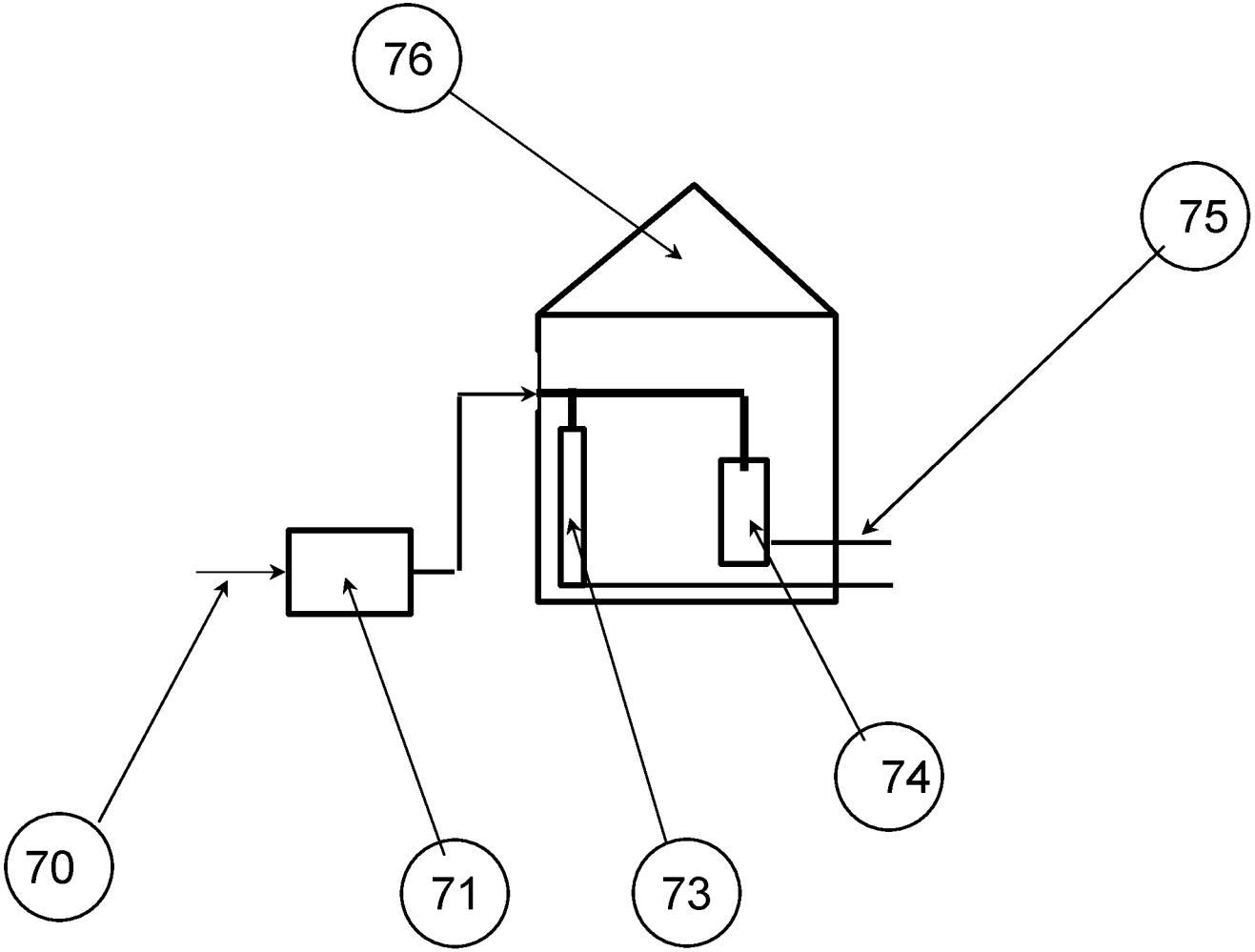
FIG. 7 is a diagram of a home using a small air liquefier to supply the home with refrigerant

FIG. 7 demonstrates the use of a small air liquefier 71 to supply the home 76 with refrigerant. Air is pulled into the inlet 70, filtered, and passes through the air liquefier 71 alternately compressing, cooling, and expanding the air until it phase changes from a gas to a liquid. To prevent icing in the lines and the cooling devices, the liquid air is processed by removing humidity and carbon dioxide. The liquid air refrigerant is stored and ready for use in the home 76. The small liquefier can be used to supply refrigerant to air conditioners 73 and refrigerators 74. The exhaust gas can be vented outside 75, or vented inside when there is a need to cool the home.

In summary, the liquid air or liquid nitrogen based system for cooling devices eliminates HCFCs, CFCs and is totally green. The output air is cleaner than the air going into the system. It can also be located remotely, off the grid, and operate very inexpensively, using solar panels as the power source. The air liquefier is scalable from a small unit to supply a single home, to a large scale air liquefier to supply a community. The storage tank may be as small as a 180 liter dewar tank or as large as a 1,000,000 liter bulk tank. The system is also scalable, and can power a single refrigerator in a home or hundreds of ULT freezers in a research facility. With an infinite raw material supply from the environmental air, receiving power from solar panels, and no exhaust pollutants, this system can be completely green.

It is to be understood that the above description is intended to be illustrative, and not restrictive. For example, the above-described embodiments (and/or aspects thereof) may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects. The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, various features may be grouped together to streamline the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

It should be recognized by those skilled-in-the-art that the present invention can be used in conjunction with any system for which cooling is desired. All patents and publications referenced herein are hereby incorporated by reference. It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. An apparatus to provide a cryogenic refrigerant of liquified gas to cool one or more devices, comprising:

an inlet filter;

an air liquefier;

an air dryer;

a separator that removes the carbon dioxide from the liquified gas;

a cryogenic bulk tank that stores the liquified gas;

a power supply coupled to the air liquefier and the air dryer;

vacuum jacketed pipes that communicate with the cryogenic bulk tank and the devices; and an exhaust system that vents the gaseous air refrigerant without releasing pollutant such as HCFCs or CFC's into the environment while cooling residential or commercial refrigerators or commercial freezers, and air conditioners using liquified gas as the refrigerant and returning refrigerant air to the environment cleaner than an input gas.

2. The apparatus of claim 1, wherein the liquified gas comprises liquid air.

3. The apparatus of claim 1, wherein the liquified gas comprises liquid nitrogen.

4. The apparatus of claim 1, wherein the power supply comprises solar panels, rechargeable batteries, or an alternate power source of power.

5. The apparatus of claim 1, further comprising Vacuum Insulated Panels located between walls of the one more devices.

6. The apparatus of claim 1, further comprising the cryogenic bulk tank scalable from 5,000 liters to 1,000,000 liters.

7. The apparatus of claim 1, further comprising an alternate storage tank of a 180 liter dewar tank outside a building.

8. The apparatus of claim 1, wherein the air liquefier is positioned in either a home or an air liquefier plant to supply a community.

9. The apparatus of claim 1, further comprising a tank truck for distributing the refrigerant to facilities that have cooling devices.

10. A cooling method, comprising:

providing a cryogenic refrigerant of liquified gas to cool one or more devices with an inlet filter; an air liquefier; an air dryer; a cryogenic bulk tank that stores the liquified gas; and vacuum jacketed pipes that communicate with the cryogenic bulk tank and the devices;

removing carbon dioxide from the liquified gas;

collecting energy and powering the air liquefier and the air dryer; and venting with an exhaust system the cryogenic refrigerant without releasing pollutant into the environment and cooling residential or commercial refrigerators or commercial freezers, and air conditioners using liquid gas as the refrigerant and returning refrigerant air to the environment cleaner than an input gas.

11. The method of claim 10, further comprising using liquid nitrogen as the refrigerant instead of liquid air by separating and providing the liquid nitrogen instead of the liquid air as the refrigerant.

12. The method of claim 10, further comprising providing power using solar panels or an alternate power source of power.

13. The method of claim 10, comprising retrofitting residential or commercial mechanical refrigerators, freezers, and ULT freezers for operation with liquid air or liquid nitrogen by replacing a mechanical compressor, a condenser, and an expansion valve with an electric solenoid valve and providing an inlet for the cryogenic refrigerant.

14. The method of claim 10, further comprising providing an improved insulation material of Vacuum Insulated Panels located between the walls of the one more devices.

15. The method of claim 10, wherein the cryogenic bulk tank stores 5,000 liters to 1,000,000 liters.

16. The method of claim 10, further comprising placing an alternate storage tank of a 180 liter dewar tank outside a building.

17. The method of claim 10, wherein the air liquefier comprises a home or an air liquefier plant supplying an entire community.

18. The method of claim 10, further comprising distributing the refrigerant to facilities that have cooling devices by using a cryogenic liquid tank truck.

* * * * *